US009707465B2

(12) United States Patent
Bittner

(10) Patent No.: US 9,707,465 B2
(45) **Date of Patent: *Jul. 18, 2017**

(54) ROBOTIC PUTTING SYSTEM

(71) Applicant: Norman Douglas Bittner, Charlotte, NC (US)

(72) Inventor: Norman Douglas Bittner, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/918,231

(22) Filed: Oct. 20, 2015

(65) Prior Publication Data

US 2016/0038817 A1 Feb. 11, 2016

Related U.S. Application Data

(63) Continuation-in-part of application No. 14/162,419, filed on Jan. 23, 2014, now Pat. No. 9,174,110.

(60) Provisional application No. 61/755,877, filed on Jan. 23, 2013.

(51) Int. Cl.

| | |
|---|---|
| ***A63B 69/36*** | (2006.01) |
| *A63B 71/02* | (2006.01) |
| *A63B 71/06* | (2006.01) |

(52) U.S. Cl.

CPC ..... *A63B 69/3676* (2013.01); *A63B 69/3644* (2013.01); *A63B 2071/026* (2013.01); *A63B 2071/0694* (2013.01); *A63B 2208/0204* (2013.01)

(58) Field of Classification Search

CPC ..... A63B 69/3644; A63B 69/3676
USPC ..... 473/229, 257–261, 264–265
See application file for complete search history.

(56) References Cited

U.S. PATENT DOCUMENTS

| | | | | |
|---|---|---|---|---|
| 2,084,901 A | | 6/1937 | Eisenberg | |
| 2,084,902 A | | 6/1937 | Eisenberg | |
| 2,303,736 A | * | 12/1942 | Hall | A63B 69/3676 473/258 |
| 2,340,793 A | * | 2/1944 | Chapman | A63B 69/3676 473/229 |
| 2,609,199 A | | 9/1952 | Koener | |
| 2,641,933 A | | 6/1953 | Van Kinkle | |
| 2,723,858 A | * | 11/1955 | Chizewski | A63B 69/3644 473/229 |
| 3,262,705 A | | 7/1966 | Nunziato | |
| 3,424,462 A | | 1/1969 | Driscoll | |
| 3,429,571 A | * | 2/1969 | Roy, Jr. | A63B 69/365 273/129 R |
| 3,471,155 A | | 10/1969 | Donaldson | |
| 4,133,535 A | * | 1/1979 | Marsh | A63B 69/3676 473/229 |
| 4,634,131 A | | 1/1987 | Vella et al. | |
| 4,758,000 A | | 7/1988 | Cox | |
| 4,789,158 A | | 12/1988 | Chiesa | |
| 4,953,867 A | | 9/1990 | Rigsby | |

(Continued)

FOREIGN PATENT DOCUMENTS

| | | |
|---|---|---|
| GB | 2308073 | 6/1997 |

*Primary Examiner* — Melba Bumgarner
*Assistant Examiner* — Laura L Davison
(74) *Attorney, Agent, or Firm* — Nixon & Vanderhye P.C.

(57) ABSTRACT

A robotic putting system includes a mechanism for actively and physically guiding a putter head along a determined preferred putting path. The golfer need only hold the putter and allow the robotic mechanism to guide the motion of the putter head. The system enables a golfer to develop and practice a feel for the preferred path/stroke.

8 Claims, 16 Drawing Sheets

(56) References Cited

U.S. PATENT DOCUMENTS

| | | | | |
|---|---|---|---|---|
| 5,125,844 | A | 6/1992 | Grant et al. | |
| 5,282,627 | A | 2/1994 | Beck | |
| 5,393,065 | A | 2/1995 | LeQuyea | |
| 5,527,041 | A | 6/1996 | Terry et al. | |
| 5,586,945 | A | 12/1996 | Vonderhaar | |
| 5,797,804 | A | 8/1998 | Chen | |
| 6,146,283 | A | 11/2000 | Ferguson, III | |
| 6,159,106 | A | 12/2000 | Adams | |
| 6,855,065 | B1 | 2/2005 | Hamilton | |
| 6,893,356 | B2 | 5/2005 | Thompson | |
| 7,160,201 | B2 | 1/2007 | Dahl | |
| 7,172,516 | B2 | 2/2007 | Wu | |
| 7,806,780 | B1 | 10/2010 | Plunkett | |
| 8,267,812 | B1 | 9/2012 | Sery | |
| 8,337,321 | B2 | 12/2012 | Bittner | |
| 8,579,720 | B2 | 11/2013 | Bittner | |
| 8,591,349 | B1 * | 11/2013 | Jones | A63B 69/3644 473/229 |
| 9,174,110 | B2 * | 11/2015 | Bittner | A63B 69/3676 |
| 2006/0128492 | A1 | 6/2006 | Hourihan et al. | |
| 2006/0141434 | A1 | 6/2006 | Moran, Jr. | |
| 2007/0238542 | A1 | 10/2007 | Pecue | |
| 2009/0082122 | A1 | 3/2009 | Kellogg | |
| 2009/0088266 | A1 | 4/2009 | McInerney | |
| 2012/0157218 | A1 | 6/2012 | Bittner | |
| 2013/0331195 | A1 | 12/2013 | Sery | |
| 2014/0065586 | A1 | 3/2014 | Gabbai | |
| 2014/0206468 | A1 | 7/2014 | Bittner | |

* cited by examiner

ROBOTIC PUTTING SYSTEM

CROSS-REFERENCES TO RELATED APPLICATIONS

This application is a continuation-in-part (CIP) of U.S. patent application Ser. No. 14/162,419, filed Jan. 23, 2014, pending, which claims the benefit of U.S. Provisional Patent Application No. 61/755,877, filed Jan. 23, 2013, the entire contents of each of which are hereby incorporated by reference in this application.

STATEMENT REGARDING FEDERALLY SPONSORED RESEARCH OR DEVELOPMENT (Not Applicable)

BACKGROUND OF THE INVENTION

The invention relates generally to a robotic device for a putting stroke and, more particularly, to a robotic device that facilitates training a player to perfect a personalized preferred putting path.

The invention relates to pending U.S. patent application Ser. No. 13/680,833 (now U.S. Pat. No. 8,579,720) and the applications from which it claims priority, the contents of all of which are hereby incorporated by reference. In that family of inventions, structure and methods are described to assist a golfer in identifying a preferred putting path. It is recognized that there is not one "perfect" path for all golfers with regard to a putting stroke, particularly with amateur golfers, but rather there is a preferred path for each individual golfer that gives that golfer the best chance for a successful putt. The system and methods in the pending patent family facilitate the identification of the golfer's preferred putting path and provide vehicles to assist the golfer in putting consistently on the preferred path.

A tracking device such as touch sensitive or proximity sensitive computer screens and the like along with sensors on the putter itself are used to determine a golfer's preferred putting path, i.e., a path for the golfer that is most likely to achieve a successful result. Using an iterative analysis, a golfer putts repeatedly on the tracking device that measures the path of the putter head and a result of the putt. The system derives the preferred path based on an average putting path for the successful putts. Once the preferred path is determined, the path can be marked or displayed on a grid box floor, which the golfer can take to the practice putting green. Additional features of the invention family may include sensors and alarms cooperable with the grid box that signal when the golfer deviates from the preferred putting path during a putt. The grid box may also be provided with a flexible wall that can be positioned to guide the golfer in following the preferred putting path and to develop muscle memory.

BRIEF SUMMARY OF THE INVENTION

The robotic putting system of the invention provides a mechanism for actively and physically guiding the putter head along the determined preferred putting path. The golfer need only hold the putter and allow the robotic mechanism to guide the motion of the putter head so that the player can develop and practice a feel for the preferred path/stroke.

In an exemplary embodiment, a robotic putting system includes a mechanism for actively and physically guiding a putter head along a putting path. The robotic putting system includes a housing defining a space for a putter head to make a putting stroke and an operating mechanism cooperable with the housing. The operating mechanism includes a servo motor connected to a worm gear and a carriage mechanism mounted on the worm gear. A clamp assembly is connected to the carriage mechanism and includes an X-component bracket that is displaceable relative to the carriage mechanism in a horizontal direction, a Y-component bracket that is displaceable relative to the carriage mechanism in a vertical direction, and a putter clamp attachable to the putter head. The putter clamp has a rail aperture therein. A rail member is positioned adjacent the space and received in the rail aperture of the putter clamp. The rail member is shaped corresponding to a predefined putting path.

The putter clamp may be connected to the X-component bracket. The clamp assembly may further include a connector bracket attached to the carriage mechanism and at least one vertical support column secured to the connector bracket. The Y-component bracket may be vertically displaceable on the at least one connector column. The X-component bracket may be coupled with the Y-component bracket such that the X-component bracket is displaceable with the Y-component bracket. The Y-component bracket may include a linear bearing there through that receives the X-component bracket.

The predefined putting path may correspond to a preferred putting path for a specific golfer such that a shape of the rail member is varied from golfer to golfer. The rail member may extend across a length of the housing. The shape of the rail member may be adjustable. In this context, the rail member may be supported on a plurality of rail brackets secured to a support bracket, where the rail brackets are selectively positionable relative to the support bracket adjust a vertical position of the rail member. The support bracket may be bendable relative to the housing to adjust a horizontal position of the rail member.

In another exemplary embodiment, a robotic putting system includes a housing defining a space for a putter head to make a putting stroke, and a clamp assembly that connects the putter head to a servo motor that rotates a worm gear. A rail member is positioned adjacent the space and received in the rail aperture of the clamp assembly. The rail member is shaped corresponding to a predefined putting path.

BRIEF DESCRIPTION OF THE DRAWINGS

These and other aspects and advantages will be described in detail with reference to the accompanying drawings, in which.

DETAILED DESCRIPTION OF THE INVENTION

Figure 2:
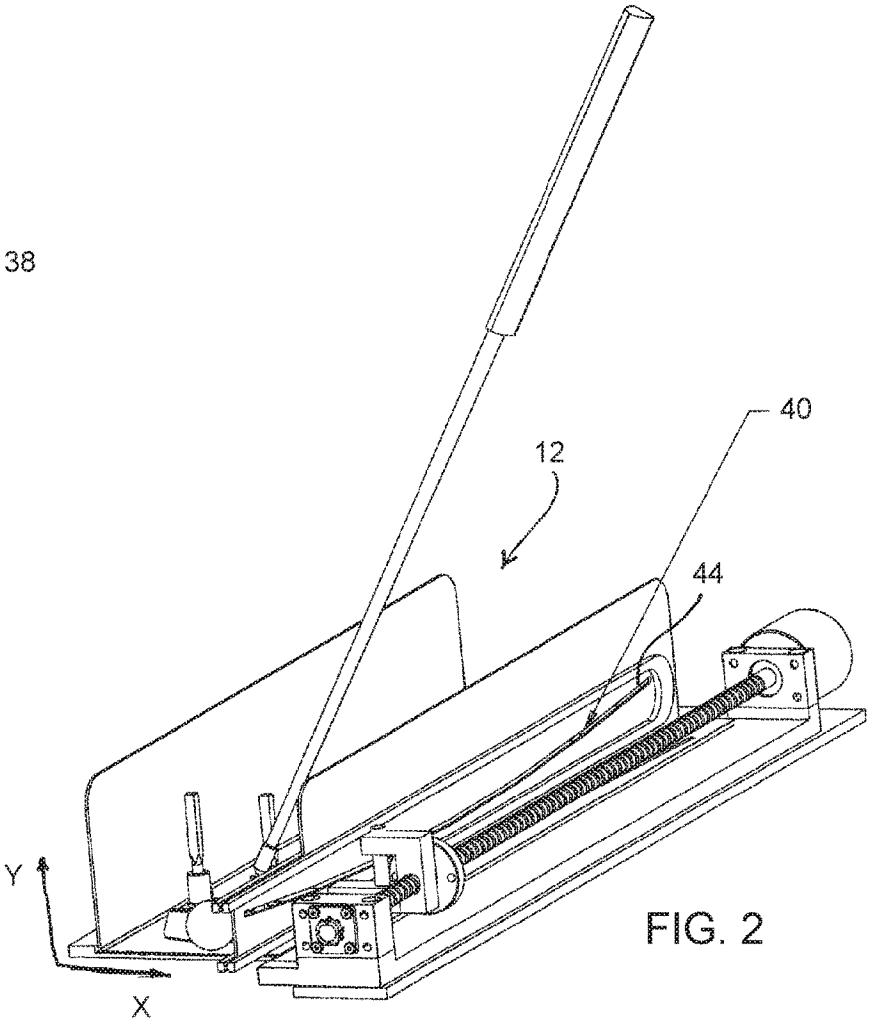
FIGS. 1-3 are perspective views of the robotic putting system.
Figure 1:
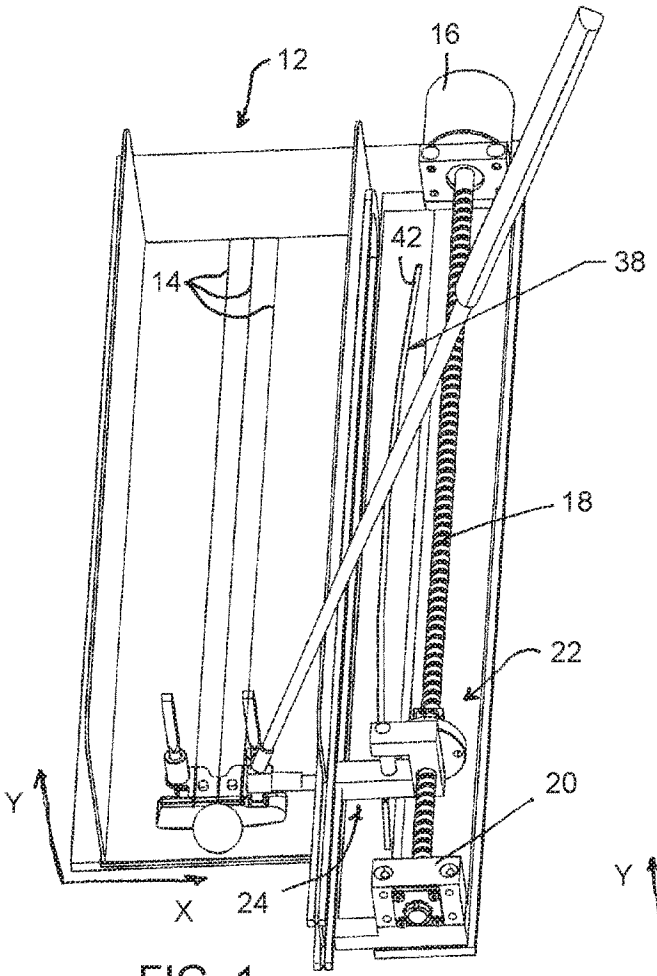
Figure 3:
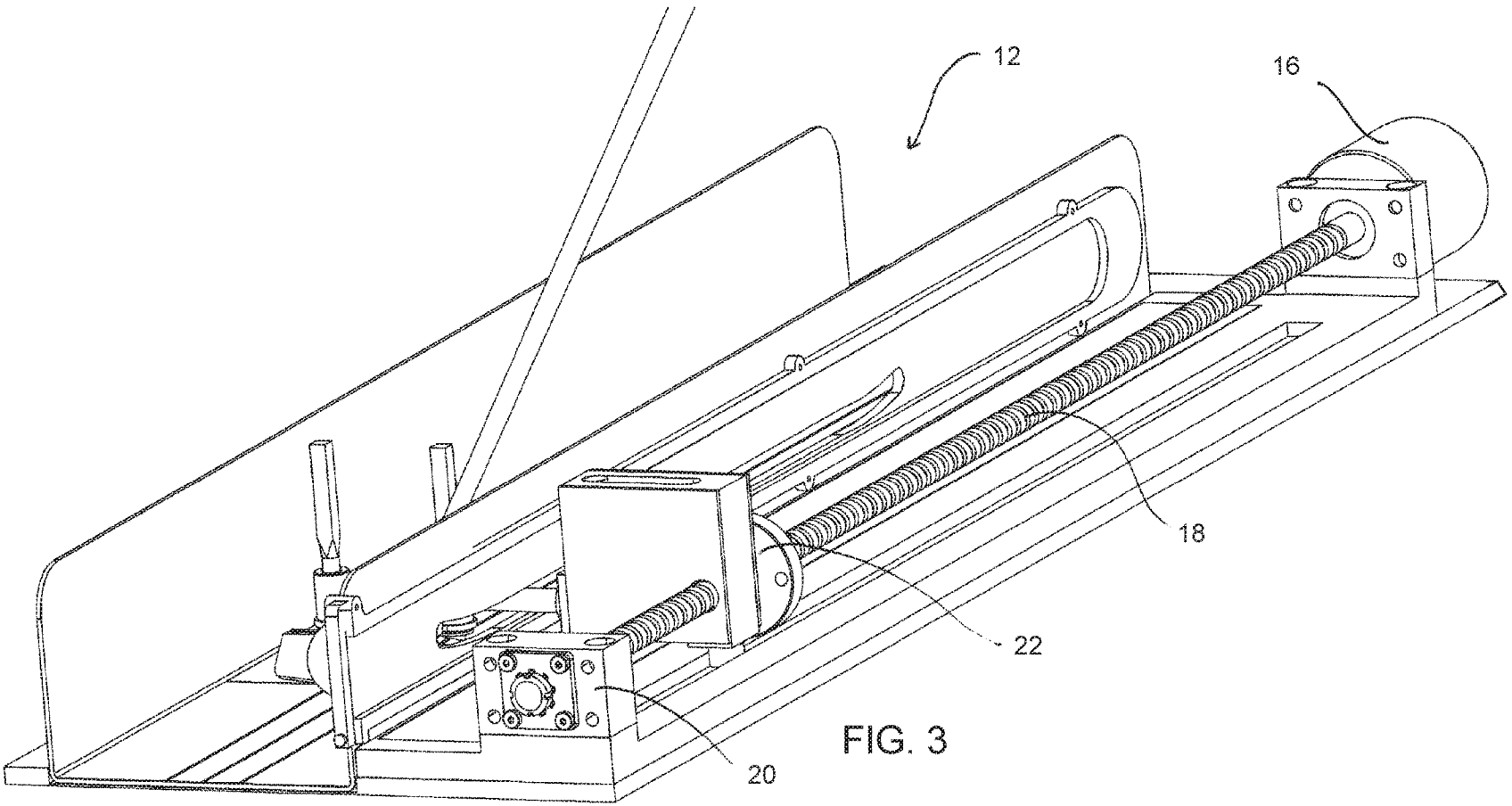

FIGS. 1-3 are perspective views of the robotic training system. A housing 12 defines a space for the putter head to make a putting stroke. The housing floor may include alignment lines 14 that are cooperable with corresponding lines attached to a top surface of the putter head. The alignment lines 14 may alternatively be aligned with the preferred putting path as determined according to the noted family of patent applications.

The operating mechanism includes a servo motor 16 connected to a worm gear/screw 18, which in turn is secured to a bearing housing 20. A carriage 22 is connected with the worm gear 18 and is displaced back and forth along the worm gear 18 by operation of the servo motor 16.

Figures 4, 5:
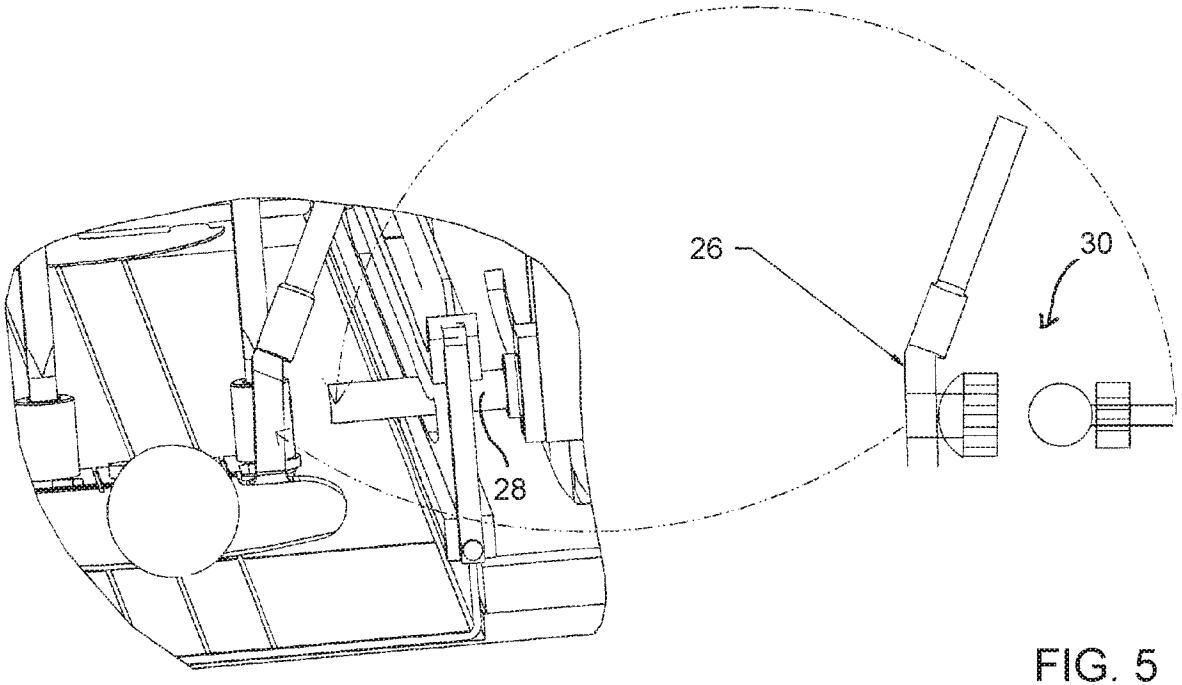
FIG. 4 is a close-up view of the hosel connector.
FIG. 5 shows a ball and socket joint cooperable with the hosel connector.

The carriage 22 supports a hosel clamp 24, which is attachable to the hosel 26 of the putter head. With reference to FIGS. 4 and 5, a shaft 28 of the hosel connector 26 extends through a wall of the housing 12 and terminates in a ball and socket joint 30. The ball and socket joint 30 can facilitate any putter placement until tightened. The joint has a quick tighten/release lever to hold the putter in position.

Figure 6:
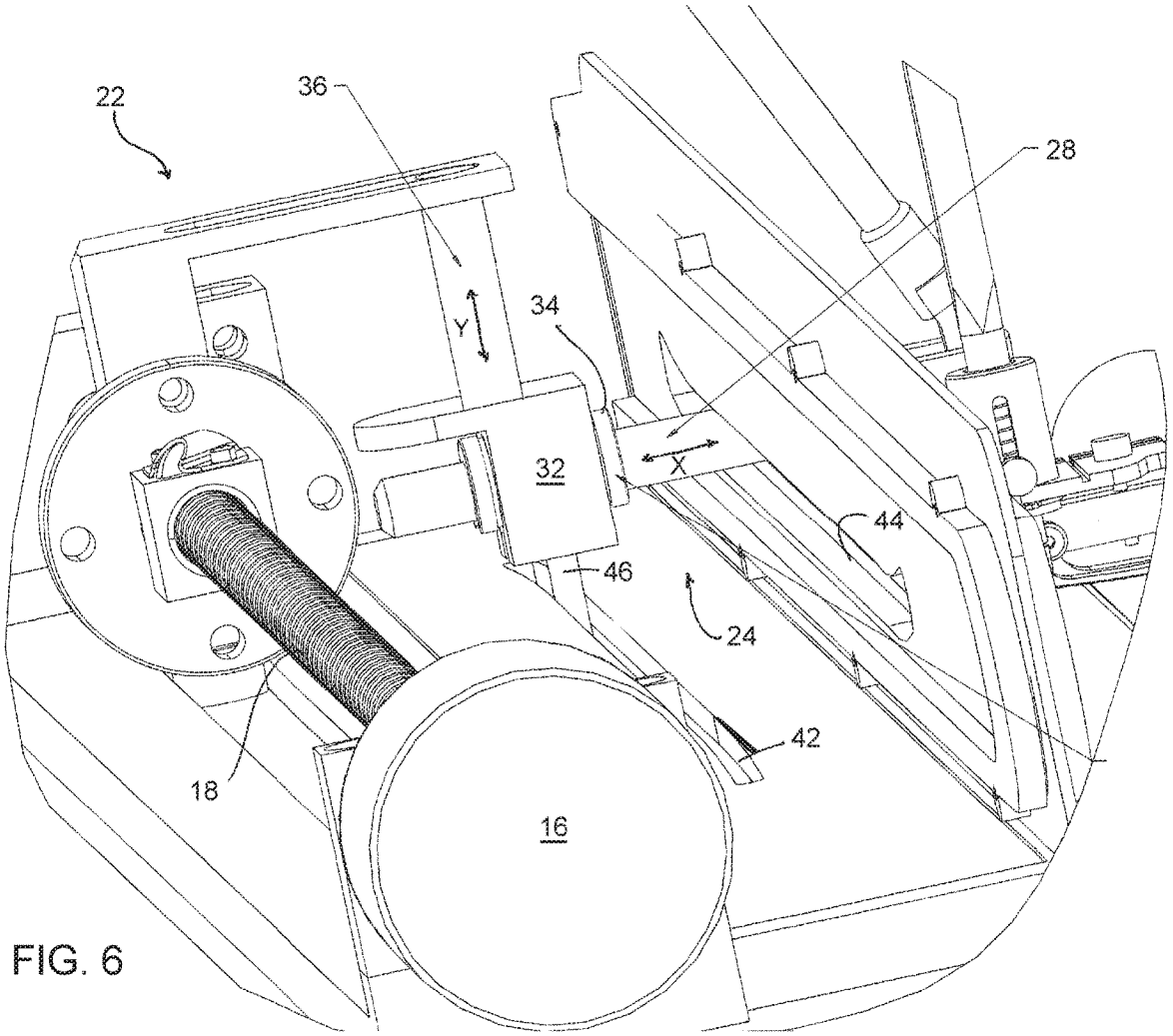
FIG. 6 is a detailed view of the carriage mechanism and the hosel clamp.

FIG. 6 shows a detailed view of the carriage mechanism 22 and the hosel clamp 24. A putter carriage 32 coupled with the carriage mechanism 22 accommodates displacement of the putter head in an X-Y plane during operation of the worm gear 18. The putter carriage 32 includes a low friction bearing that receives the shaft 28 for displacement of the putter head horizontally (see arrow X in FIG. 6). The putter carriage 32 also accommodates a vertical guide 36 over which the putter carriage 32 is displaceable in a vertical direction (see arrow Y in FIG. 6).

Referring again to FIGS. 1 and 2, in order to guide the putter head along the preferred putting path, two templates 38, 40 are produced based on the X and Y components of the preferred putting path, respectively. The X component template 38 controls a horizontal position of the putter head (X direction) as the carriage 22 is moved back and forth by the worm gear 18. A Y component template 40 (FIG. 2) controls vertical movement of the putter head (Y direction) during the putting stroke. Each of the templates 38, 40 includes a corresponding cam slot 42, 44 in which a cam follower coupled with the putter carriage 32 is engaged. As shown in FIG. 6, the putter carriage 32 includes a cam follower or pin guide 46 engaging the cam slot 42 in the X component template 38, and the shaft or horizontal guide 28 extends through the cam slot 44 in the Y component template 40.

The templates 38, 40 are customized for each golfer depending on the golfer's preferred putting path. The templates 38, 40 are easily insertable and removable in corresponding template slots. Other characteristics of the golfer's preferred stroke are also taken into account, including, without limitation, speed of drawback, length of drawback relative to distance of putt, putter characteristics (weight of putter, balance, putter type, etc.), etc. In this manner, the system can be customized for each golfer according to the golfer's unique preferred putting path. The golfer learns the feel of a successful putt including how hard to strike the ball based on putting distance, how far back to draw club based on putting distance, etc.

Figure 7:
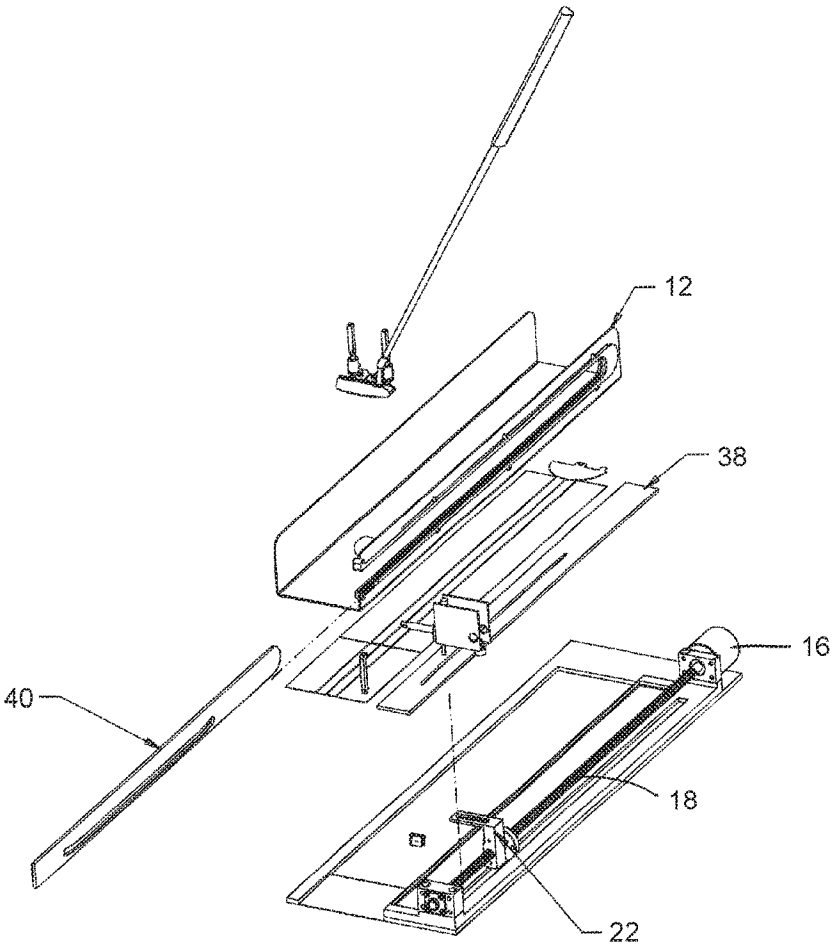
FIG. 7 is an exploded view showing the parts of the robotic putting mechanism.
Figure 8:
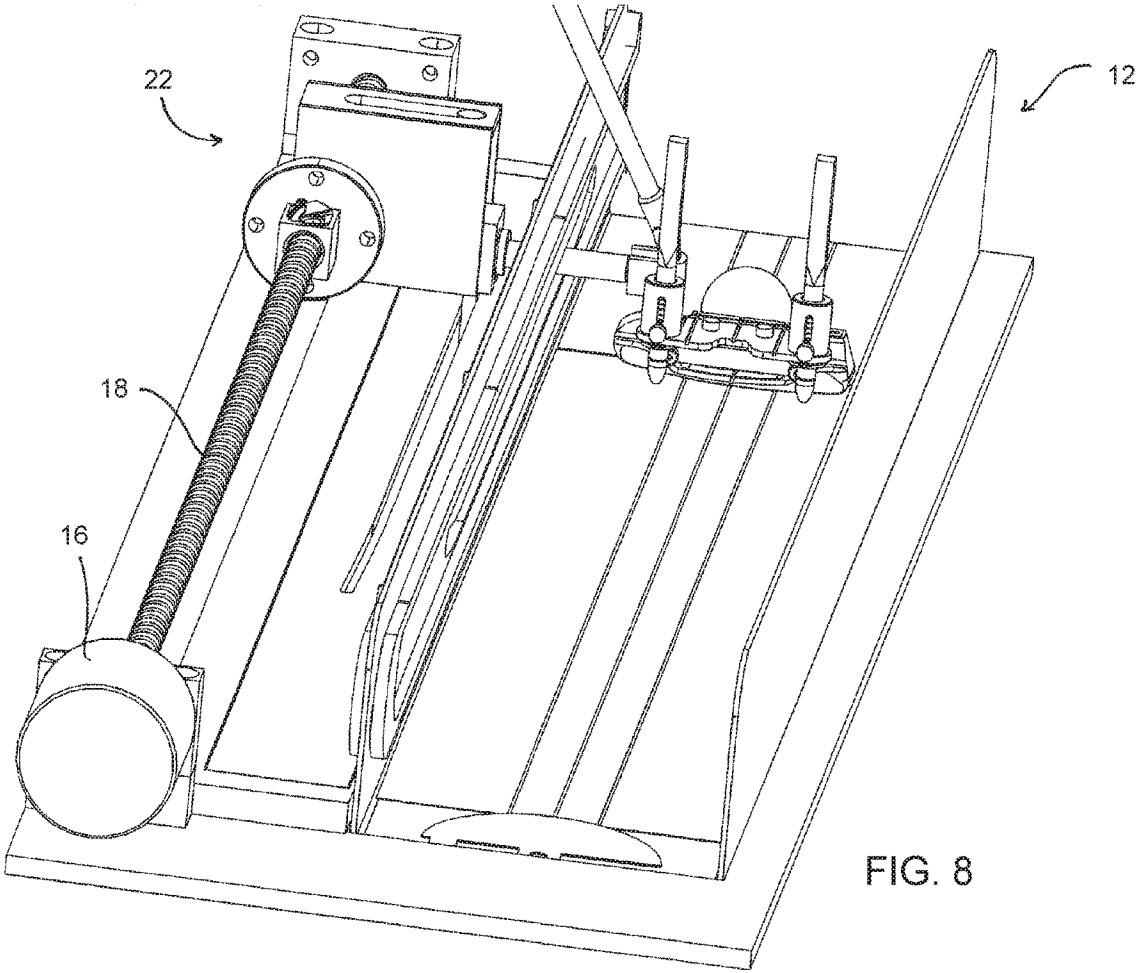
FIGS. 8-13 show various views of the assembly.
Figure 9:
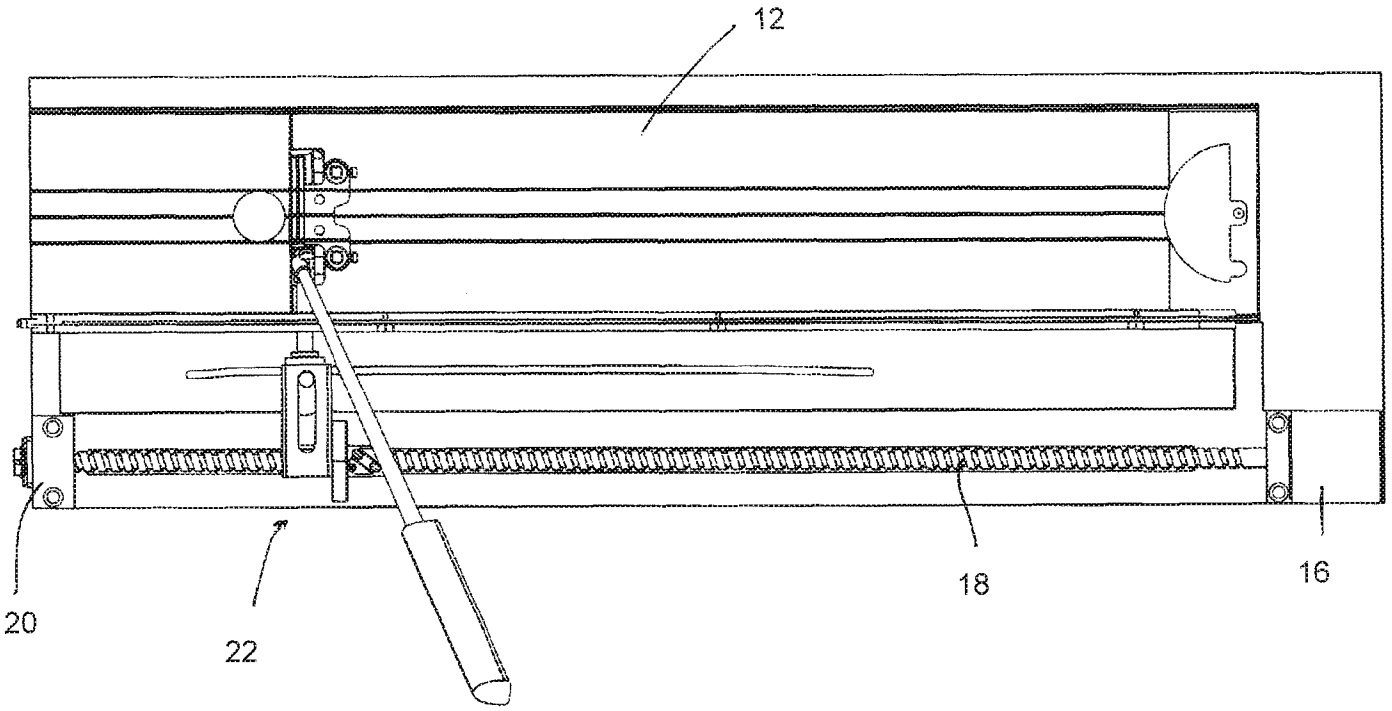
Figure 10:
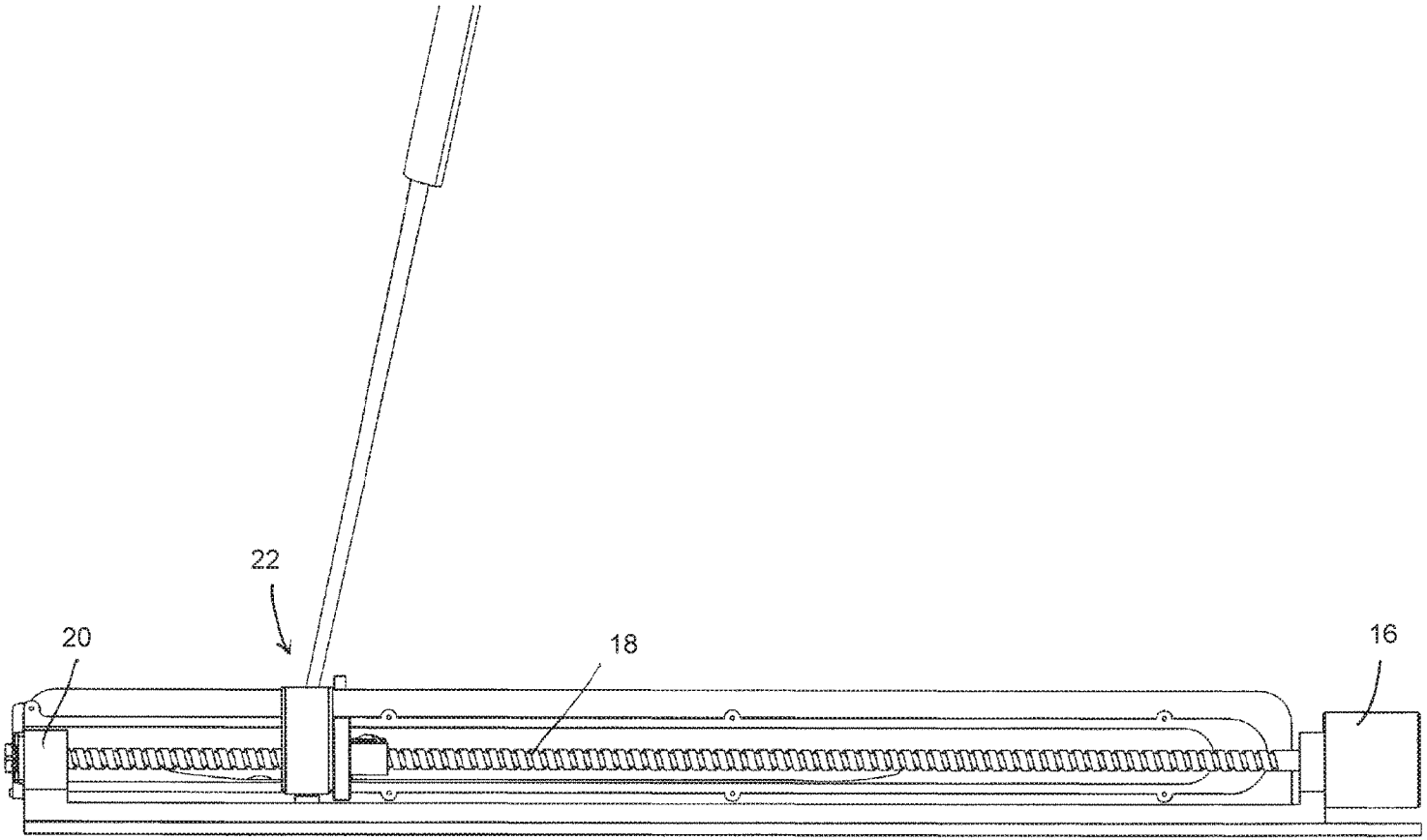
Figure 11:
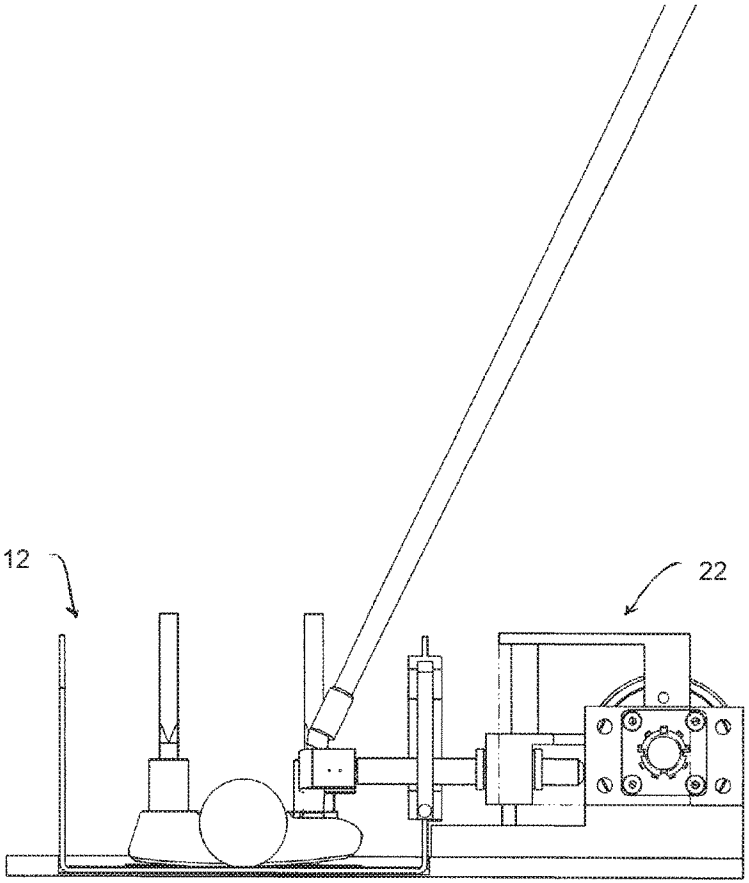
Figure 12:
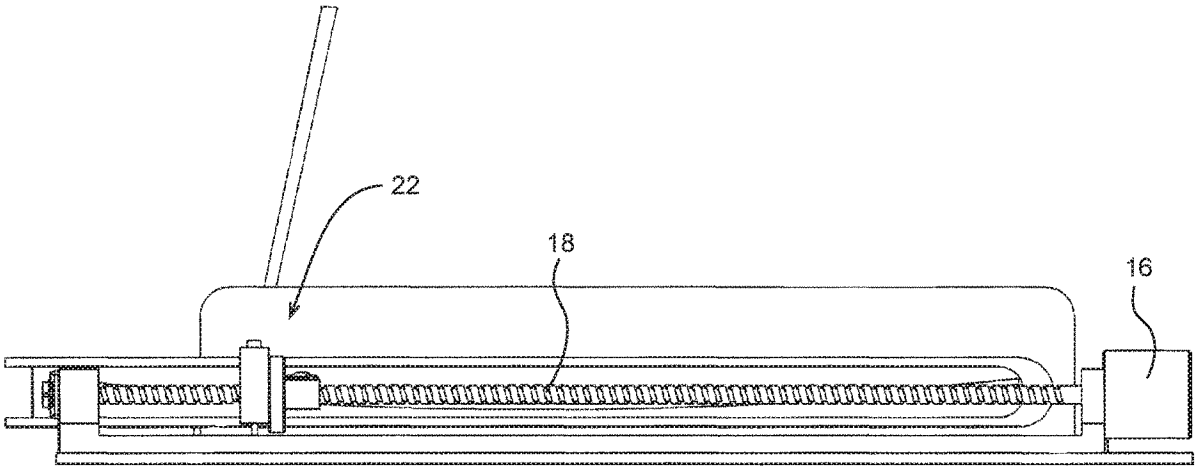
Figure 13:
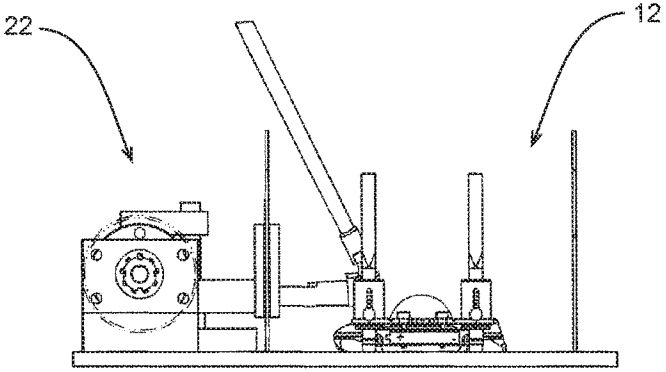

FIG. 7 is an exploded view showing the parts of the robotic putting mechanism. FIGS. 8-13 show various views of the assembly. FIG. 13 shows a battery pack that forms part of an attachment securable to the putter head. As described in the noted family of patent applications, the battery pack may be used to power diodes that are responsive to optical sensors that determine whether the putter head is following a line or series of lines imprinted on the housing floor. As described in alternative embodiments, the battery pack may instead be positioned in the handle of the golf club. The attachment supporting the battery pack can be removed for use with the robotic mechanism.

FIGS. 14-18 illustrate an alternative embodiment of a robotic putting system. The alternative embodiment utilizes a rail member to control a position of the putter head across the full stroke of the putting path. Additionally, the clamp assembly for accommodating horizontal and vertical displacement of the putter head during the putting stroke is simplified.

Figure 14:
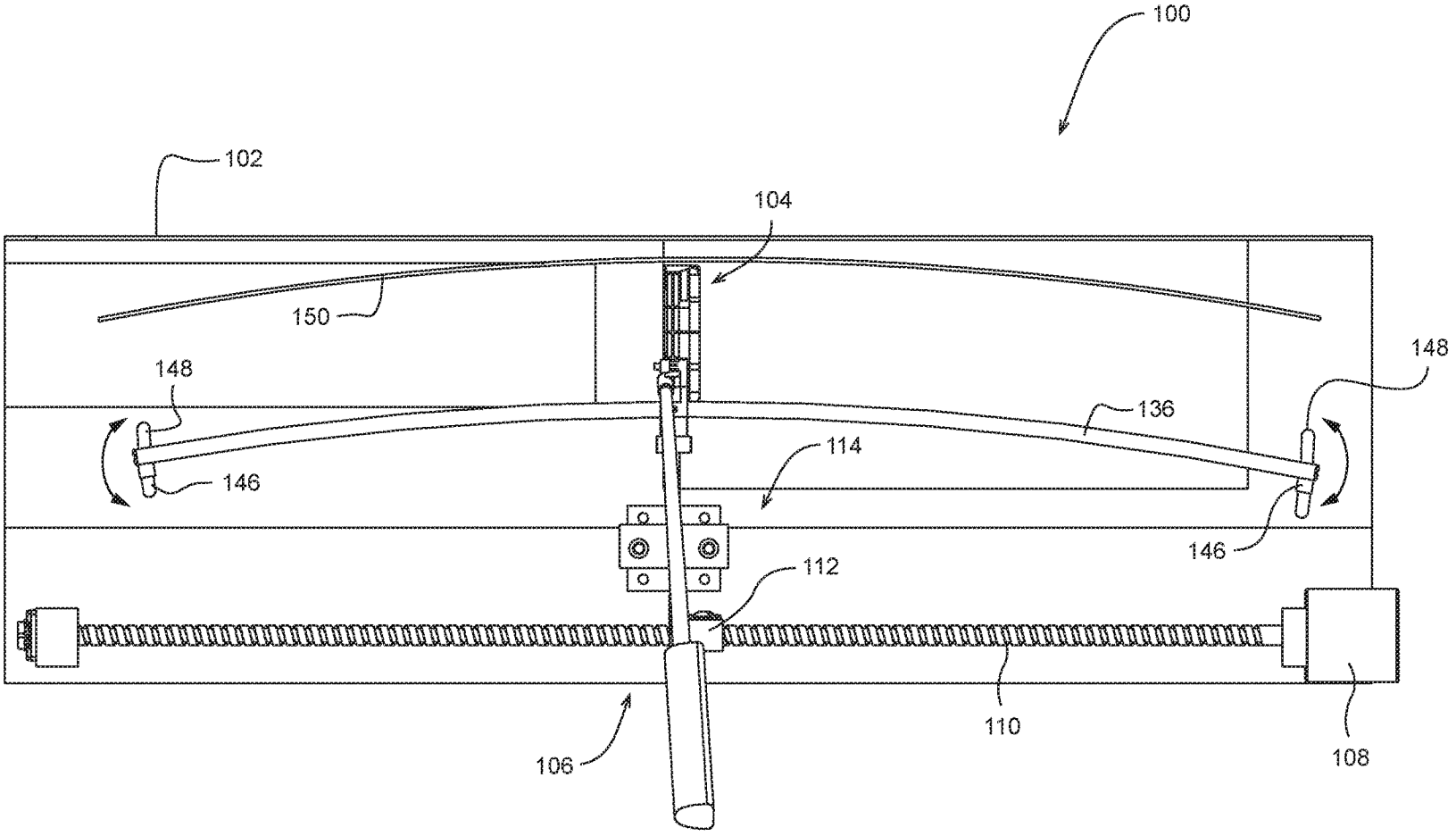
FIG. 14 is a plan view of a robotic putting system according to an alternative embodiment.
Figure 15:
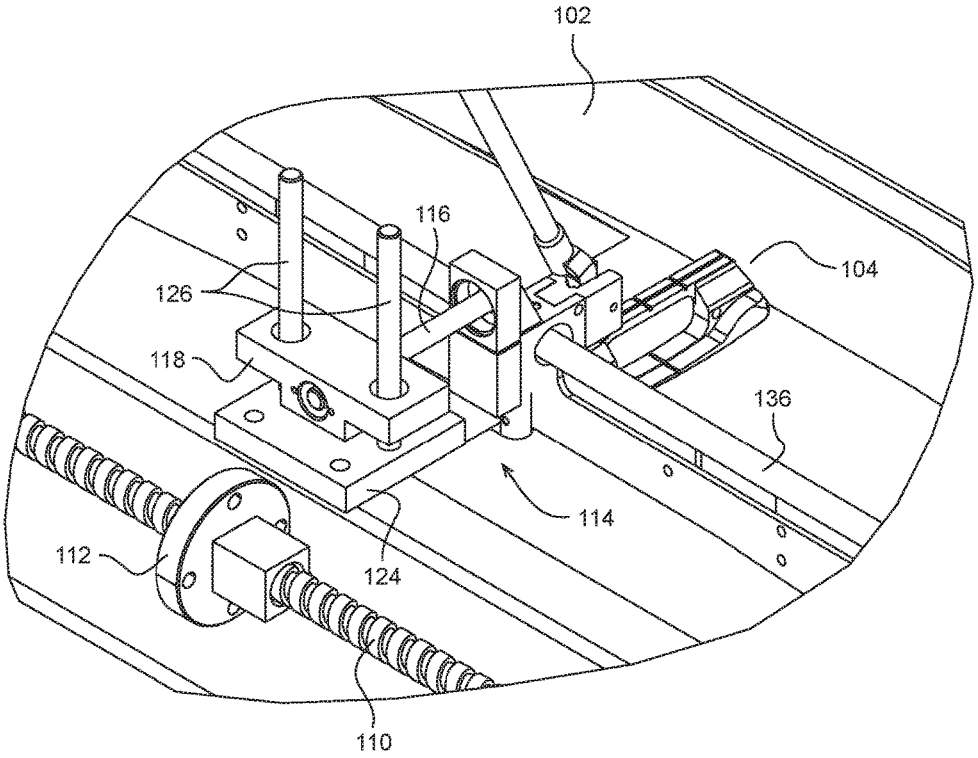
FIGS. 15, 15A, 15B and 16 are perspective views of the FIG. 14 embodiment.
Figure 16:
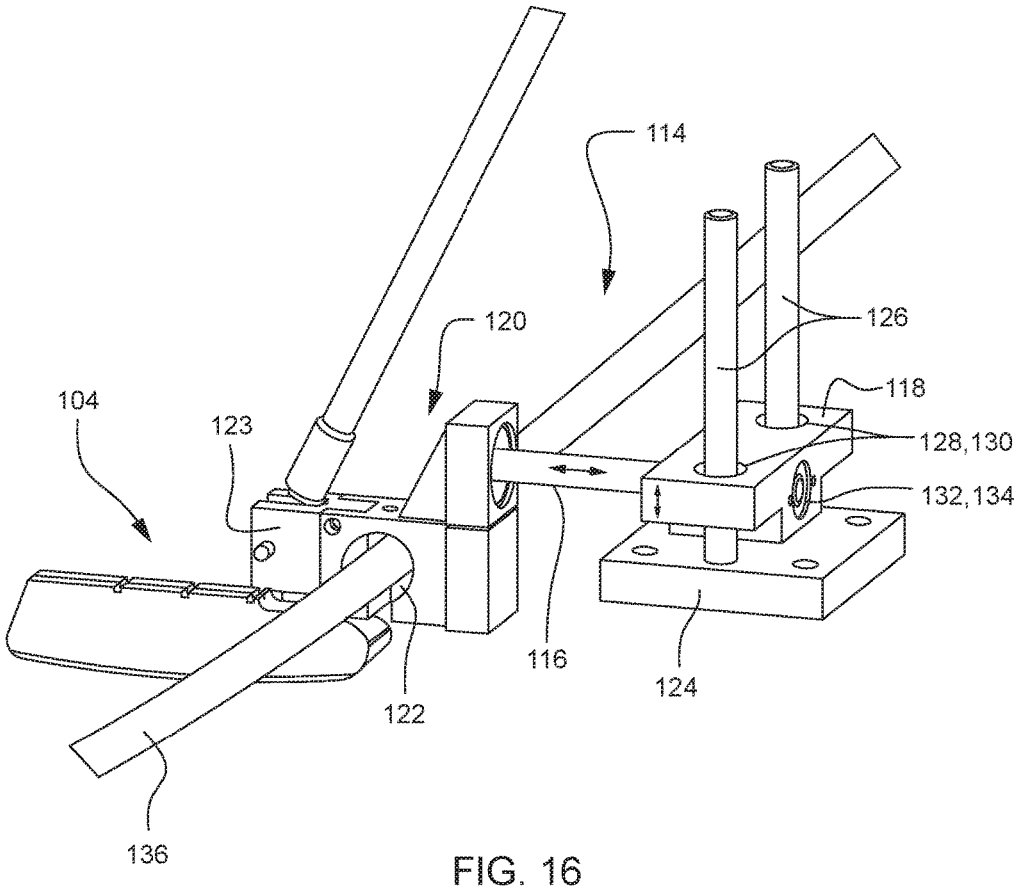

With reference to FIGS. 14-16, the robotic putting system 100 of this embodiment similarly includes a housing 102 defining a space for a putter head 104 to make a putting stroke. An operating mechanism 106 is cooperable with the housing 102 and includes a servo motor 108 connected to a worm gear 110 and a carriage mechanism 112 mounted on the worm gear 110. Like the previous embodiment, the motor 108 is operated in forward and reverse directions to control a position of the carriage 112. The motor 108 is preferably controlled via computer input, which provides a controlled stroke incorporating detailed stroke characteristics including length of stroke, speed of stroke, etc. The length and speed of the stroke are varied/controlled based on several factors of the preferred putting stroke including a length of putt, simulated green conditions, characteristics of the putter head, etc.

Figure 15A:
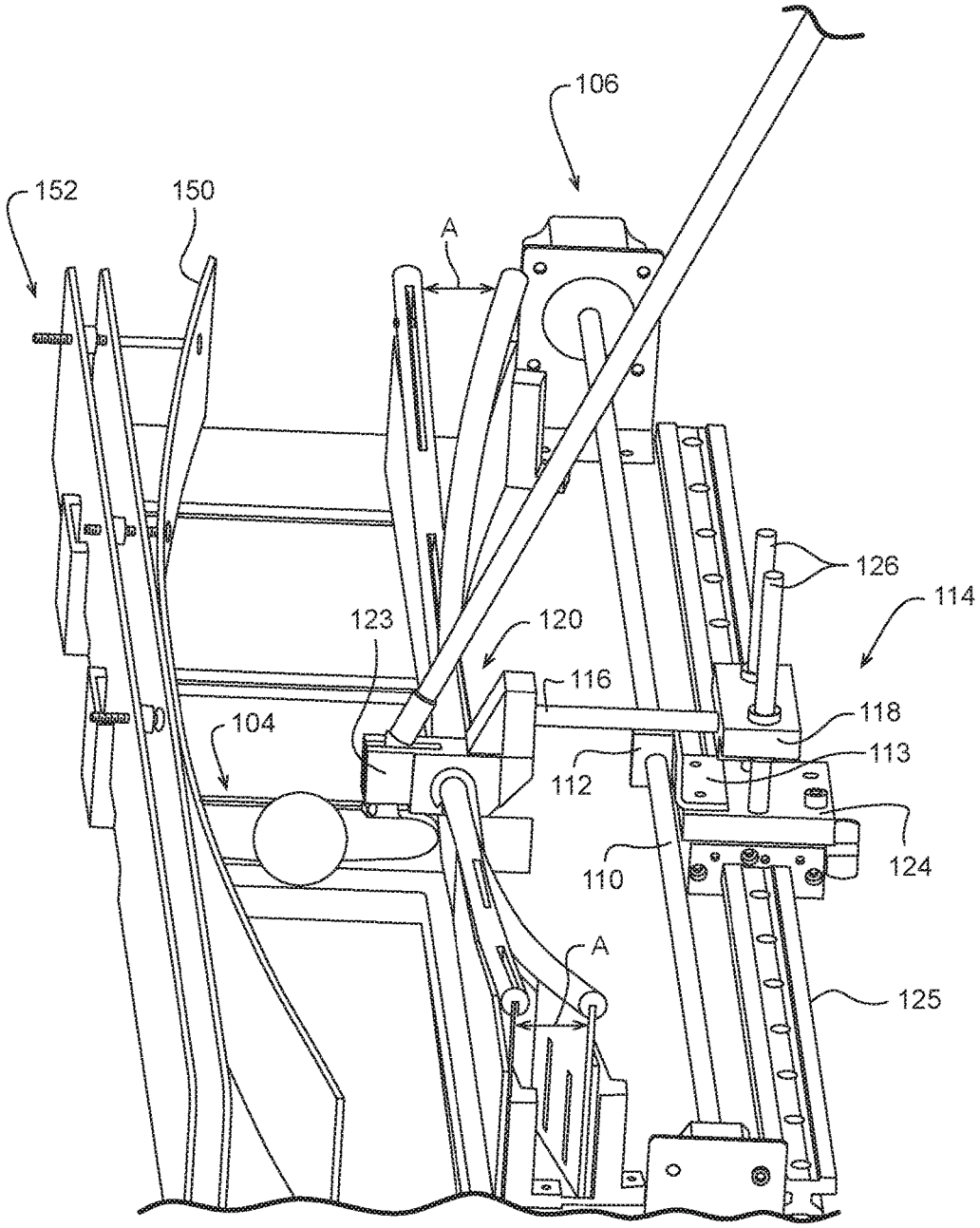
Figure 15B:
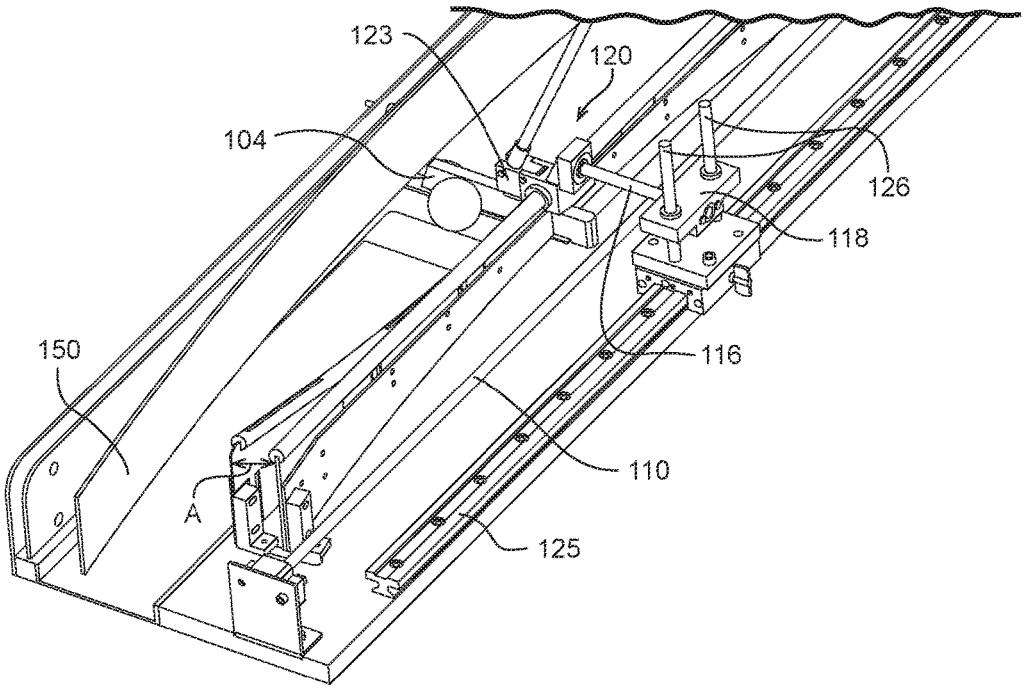

A clamp assembly 114 connects the carriage mechanism 112 to the putter head 104. The clamp assembly 114 may be secured to the carriage mechanism in any suitable manner. In one exemplary configuration shown in FIG. 15A, the carriage mechanism 112 is attached to an L-bracket 113 by connectors such as screw or the like, which in turn is secured to the clamp assembly 114 by similar connectors. As shown in FIGS. 14 and 15, the operating mechanism 106 may be positioned on a golfer side of the clamp assembly 114, or as shown in FIGS. 15A and 15B, the operating mechanism 106 may be positioned on a housing side of the clamp assembly 114. The position shown in FIGS. 15A and 15B results in a slightly more compact construction.

With specific reference to FIGS. 15A, 15B and 16, the clamp assembly 114 includes an X-component bracket 116 that is displaceable relative to the carriage mechanism 112 and the clamp assembly 114 in a horizontal direction. Any directional indications referenced herein are used in a normal sense relative to gravity. The horizontal displacement of the putter head with respect to the clamp assembly 114 refers to the directions indicated by the arrows on the X-component bracket 116 in FIG. 16. A Y-component bracket 118 is displaceable relative to the carriage mechanism 112 and the clamp assembly 114 in a vertical direction (see the arrows on the Y-component bracket 118 in FIG. 16). The clamp assembly also includes a putter clamp 120 that is attachable to the putter head 104. The putter clamp 120 includes a rail aperture 122 therein as shown in FIG. 16.

The putter clamp 120 is preferably connected to the X-component bracket 116. The connection between the putter clamp 120 and the X-component bracket 116 is generally a fixed connection, and any suitable connection may be used. An opposite end of the putter clamp 120 includes a gripping mechanism or hosel clamp 123 or the like that attaches directly to the hosel adjacent the putter head 104. Any suitable structure for securing the putter head via the hosel or the like to the putter clamp 122 may be used.

The clamp assembly 114 may additionally be provided with a connector bracket 124 that is attached directly to the carriage mechanism 112 in any suitable manner. The connector bracket 124 may be displaceable along a length of the housing 102 on a slide member 125 (see FIGS. 15A, 15B). In one arrangement, at least one vertical support column 126 (two shown) is secured to the connector bracket 124. The Y-component bracket 118 may be vertically displaceable on the connector columns 126. In one arrangement, the Y-component bracket 118 includes column apertures 128 that receive the connector columns 126. A linear bearing 130 or the like may be disposed within the apertures 128 to facilitate vertical displacement of the Y-component bracket 118 on the columns 126.

An opposite end of the X-component bracket 116 may be coupled with the Y-component bracket 118 such that the X-component bracket 116 is displaceable with the Y-component bracket 118. The Y-component bracket 118 may be provided with an aperture 132 therethrough through which the X-component bracket 116 is received. The aperture 132 may include a linear bearing 134 or the like to facilitate relative horizontal movement between the X-component bracket 116 and the Y-component bracket 118.

The robotic putting system 100 may additionally include a rail member 136 positioned adjacent the housing space and received in the rail aperture 122 of the putter clamp 120. In a preferred construction, the rail member 136 is shaped corresponding to a predefined putting path. In this context, consistent with the described concepts relating to a preferred putting path in the noted family of inventions, the predefined putting path preferably corresponds to a preferred putting path for a specific golfer. As such, a shape of the rail member 136 is adjustable and variable from golfer to golfer. That is, once the golfer's preferred putting path is determined according to the concepts described in the noted family of inventions, the rail member 136 is shaped so that the putter head 104 is guided across the preferred putting path during a putting stroke, which is driven by the operating mechanism 106 via the clamp assembly 114. In this manner, the golfer need only hold the putter handle and allow the robotic putting system to guide the motion of the putter head. The system thus enables a golfer to develop and practice a feel for that particular golfer's preferred putting path/stroke for various distances and directions.

Figure 17:
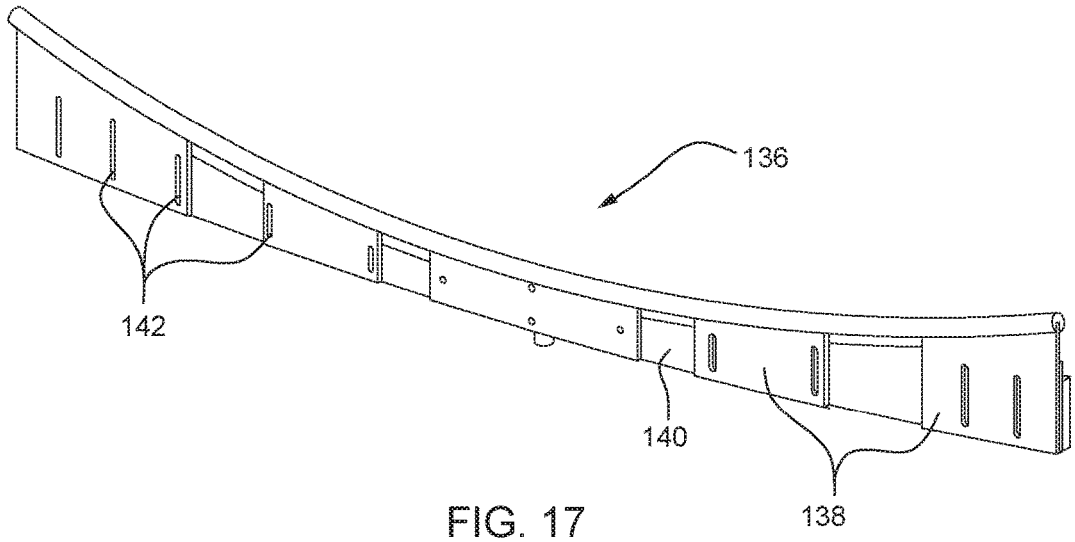
FIG. 17 shows the rail member of the FIG. 14 embodiment from the club side.
Figure 18:
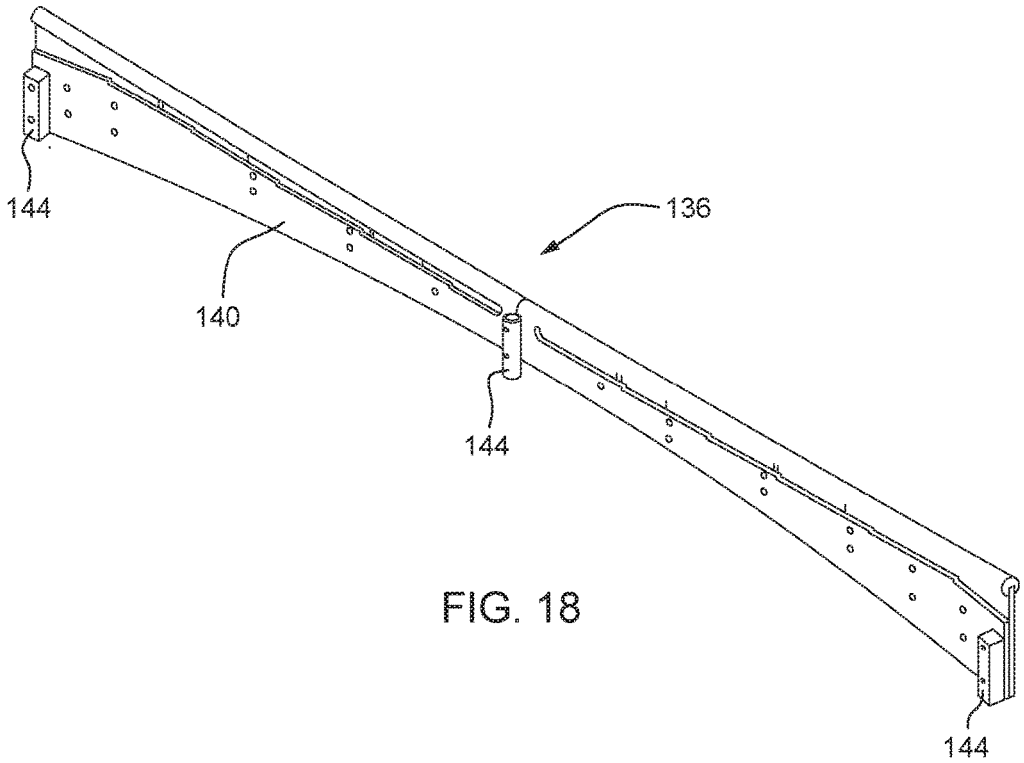
FIG. 18 shows the rail member of the FIG. 14 embodiment from the golfer side.

As shown in FIG. 14, the rail member 136 generally extends across a length of the housing 102. As noted, the shape of the rail member 136 is adjustable to accommodate a preferred putting path for a particular golfer. FIGS. 17 and 18 show the rail member 136 from the club side and the golfer side, respectively. As shown, the rail member 136 may be supported on a plurality of rail brackets 138 secured to a support bracket 140. The support bracket 140 is preferably affixed to the housing 102 in any suitable manner. The rail member 136 is preferably secured to the rail brackets 138 via a slot or the like (as shown in the end views of FIGS. 17 and 18). The rail brackets 138 include adjustment slots 142 so that the rail brackets 138 are selectively positionable relative to the support bracket 140 to adjust a vertical position of the rail member 136. The support bracket 140 may be secured to the housing via support posts 144 secured, for example, at each end of the rail member and at a central location. The posts 144 can also serve as fixed references for defining the preferred putting path via the shape of the rail member 136.

The rail member 136 and the support bracket 140 are bendable relative to the housing to thereby adjust a horizontal position of the rail member 136 across the putting path. The rail member 136 is secured to the housing 102 at end of the rail member 136 by connectors 146 that are selectively positionable in slots 148 in the housing floor. See the arrows adjacent the connectors 146 and slots 148 in FIG. 14. FIGS. 15A and 15B show an exemplary range A over which the ends of the rail member 136 may be adjusted to arrive at the desired putting path shape for the rail member 136.

The housing may also be provided with a guide wall 150 (see FIGS. 14, 15A, 15B) that is disposed adjacent a toe side of the putter head 104. The guide wall 150 can assist in guiding the putter head 104 through the putting stroke and may also provide a visual guidance for the golfer during the putting stroke. The guide wall 150 is thus bendable as shown relative to the housing 102 in various configurations to accommodate the preferred putting stroke of the particular golfer. The guide wall 150 is positionable using any suitable configuration. An exemplary configuration is utilizes an adjustable screw assembly 152 to set a position of the guide wall 150 (see FIG. 15A).

Other features of the housing as described in the noted family of patents may be incorporated into the robotic putting system of the described embodiments. For example, the housing may incorporate one or more alignment lines on a bottom surface thereof to assist the golfer in viewing the path of the putting stroke. The putter head may be provided with a sensor that detects when the golfer deviates from the alignment line(s) (as discussed above). The housing may also include a removable insert with the alignment lines or the like showing the preferred putting path, which insert may be separable from the housing and used for practice on a putting green. Still further, instead of a preferred putting stroke for a particular golfer, a standard putting stroke may be used, or the golfer may be able to select the putting stroke of a known professional golfer.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A robotic putting system comprising:

a housing defining a space for a putter head to make a putting stroke;

an operating mechanism cooperable with the housing, the operating mechanism including a servo motor connected to a worm gear, and a carriage mechanism mounted on the worm gear;

a clamp assembly connected to the carriage mechanism, the clamp assembly including an X-component bracket that is displaceable relative to the carriage mechanism in a horizontal direction, a Y-component bracket that is displaceable relative to the carriage mechanism in only a vertical direction, and a putter clamp attachable to the putter head, the putter clamp including a rail aperture therein, wherein the X-component bracket extends through an aperture in the Y-component bracket and is horizontally displaceable relative to the carriage mechanism through the Y-component bracket; and a rail member positioned adjacent the space and received in the rail aperture of the putter clamp, the rail member being shaped corresponding to three dimensions of a predefined putting path, wherein the predefined putting path corresponds to a preferred putting path for a specific golfer such that a shape of the rail member is varied from golfer to golfer.

2. A robotic putting system according to claim 1, wherein the putter clamp is connected to the X-component bracket.

3. A robotic putting system according to claim 2, wherein the clamp assembly further comprises a connector bracket attached to the carriage mechanism, the clamp assembly including at least one vertical support column secured to the connector bracket, wherein the Y-component bracket is vertically displaceable on the at least one vertical support column.

4. A robotic putting system according to claim 1, wherein the Y-component bracket comprises a linear bearing therethrough, the linear bearing receiving the X-component bracket.

5. A robotic putting system according to claim 1, wherein the rail member extends across a length of the housing.

6. A robotic putting system according to claim 1, wherein the shape of the rail member is adjustable.

7. A robotic putting system according to claim 6, wherein the rail member is supported on a plurality of rail brackets secured to a support bracket, wherein the rail brackets are selectively positionable relative to the support bracket to adjust a vertical position of the rail member.

8. A robotic putting system according to claim 7, wherein the support bracket is bendable relative to the housing to adjust a horizontal position of the rail member.

* * * * *